US009163448B2

(12) United States Patent
Imaoka

(10) Patent No.: US 9,163,448 B2
(45) Date of Patent: Oct. 20, 2015

(54) WINDOW REGULATOR

(71) Applicant: HI-LEX CORPORATION, Takarazuka-shi (JP)

(72) Inventor: Takayuki Imaoka, Takarazuka (JP)

(73) Assignee: HI-LEX CORPORATION, Takarazuka-shi (JP)

( * ) Notice: Subject to any disclaimer, the term of this patent is extended or adjusted under 35 U.S.C. 154(b) by 0 days.

(21) Appl. No.: 14/353,816

(22) PCT Filed: Oct. 25, 2012

(86) PCT No.: PCT/JP2012/077646
§ 371 (c)(1),
(2) Date: Apr. 24, 2014

(87) PCT Pub. No.: WO2013/062060
PCT Pub. Date: May 2, 2013

(65) Prior Publication Data

US 2014/0298725 A1 Oct. 9, 2014

(30) Foreign Application Priority Data

Oct. 25, 2011 (JP) ..... 2011-234424

(51) Int. Cl.
*E05F 15/689* (2015.01)
*E05F 11/48* (2006.01)
*E05F 5/00* (2006.01)

(52) U.S. Cl.
CPC ..... *E05F 15/689* (2015.01); *E05F 5/003* (2013.01); *E05F 11/483* (2013.01); (Continued)

(58) Field of Classification Search
CPC ..... E05F 15/689; E05F 11/483; E05F 5/003
USPC ..... 49/348–352, 360–363
See application file for complete search history.

(56) References Cited

U.S. PATENT DOCUMENTS 4,253,277 A * 3/1981 Campbell et al. ..... 49/352
4,663,886 A * 5/1987 Nakamura et al. ..... 49/360
(Continued)

FOREIGN PATENT DOCUMENTS

JP 09025764 1/1997
JP 2005113441 4/2005
(Continued)

OTHER PUBLICATIONS

International Search Report, App. PCT/JP2012/077646, dated Dec. 11, 2012.

*Primary Examiner* — Katherine Mitchell
*Assistant Examiner* — Marcus Menezes
(74) *Attorney, Agent, or Firm* — Perman & Green, LLP

(57) ABSTRACT

There is provided a window regulator in which there is no need to provide a bracket for fixing a stopper and which can surely support an impact caused when the stopper abuts a carrier plate. The window regulator includes: a carrier plate, a guide rail, a direction changing member, a drive unit, a raising wire, and a lowering wire, where the drive unit has a drum, a motor for driving the drum and a housing, and the housing has a drum housing portion for housing the drum, a guide rail connecting portion to be connected to the guide rail, a stopper which abuts the carrier plate when the carrier plate reaches its lower limit position and prevents the carrier plate from further lowering therefrom, and a stopper supporting portion provided below the stopper in the lowering direction of the carrier plate.

4 Claims, 3 Drawing Sheets

(52) U.S. Cl.
CPC ..... *E05F 11/486* (2013.01); *E05Y 2201/224* (2013.01); *E05Y 2600/40* (2013.01); *E05Y 2600/41* (2013.01); *E05Y 2600/626* (2013.01); *E05Y 2800/73* (2013.01)

(56) References Cited

U.S. PATENT DOCUMENTS

| | | | | | |
|---|---|---|---|---|---|
| 5,074,077 | A | * | 12/1991 | Toyoshima et al. | 49/352 |
| 6,061,963 | A | * | 5/2000 | Osborn et al. | 49/352 |
| 6,115,966 | A | * | 9/2000 | Shibata | 49/352 |
| 7,765,739 | B2 | * | 8/2010 | Munezane et al. | 49/352 |
| 8,127,495 | B2 | * | 3/2012 | Eckhardt et al. | 49/352 |
| 8,720,114 | B2 | * | 5/2014 | Matsushita | 49/352 |
| 2004/0154227 | A1 | * | 8/2004 | Yoshimura | 49/352 |
| 2005/0072050 | A1 | | 4/2005 | Yamamoto | |
| 2007/0251148 | A1 | * | 11/2007 | Watson et al. | 49/352 |
| 2012/0117883 | A1 | * | 5/2012 | Matsushita | 49/348 |

FOREIGN PATENT DOCUMENTS

| | | |
|---|---|---|
| JP | 2005232864 | 9/2005 |
| JP | 2008240515 | 10/2008 |

* cited by examiner

WINDOW REGULATOR

CROSS-REFERENCE TO RELATED APPLICATIONS

This application is the National Stage of International Application No. PCT/JP2012/077646 having International Filing date, 25 Oct. 2012, which designated the United States of America, and which International Application was published under PCT Article 21 (s) as WO Publication 2013/062060 A1 and which claims priority from, and the benefit of, Japanese Application No. 2011-234424 filed 25 Oct. 2011, the disclosures of which are incorporated herein by reference in their entireties.

BACKGROUND

The presently disclosed embodiment relates to a window regulator to be provided to doors and the like of a vehicle.

Conventionally, in a window regulator, a stopper for restricting the movement of a carrier plate by abutting on the carrier plate so that the carrier plate does not lower a predetermined distance or more, is provided.

JP09-025764A discloses a stopper structure of a window regulator, in which a stopper member is fixed to a lower bracket mounted on a lower end of a guide provided along an raising and lowering direction of a door glass.

Further, JP2005-232864A discloses a door window regulator structure, in which a stopper is provided on a bracket supporting a lower end of a rail guiding raising and lowering movement of a carrier plate.

SUMMARY

However, when a stopper for restricting the movement of a carrier plate is fixed to a bracket provided on a guide rail as shown in JP09-025764A and JP2005-232864A, the bracket must be made thicker so as not to be deformed due to an impact caused when the stopper abuts the carrier plate, and therefore, there is a problem of increase in weight. In addition, because of using the bracket, there is a problem of increase in the number of components.

The presently disclosed embodiment has been made in the light of the problems mentioned above, and it is an object of the presently disclosed embodiment to provide a window regulator in which there is no need to provide a bracket for fixing a stopper and which can surely support an impact caused by the abutting of the carrier plate.

In order to achieve the above-mentioned object, the window regulator of the presently disclosed embodiment is characterized by comprising a carrier plate connected to a window glass of a vehicle, a guide rail for guiding raising and lowering movement of the carrier plate, a direction changing member provided at one end of the guide rail, a drive unit provided at another end of the guide rail, a raising wire, one end of which is connected to the carrier plate and another end of which is connected to the drive unit via the direction changing member, and a lowering wire, one end of which is connected to the carrier plate and another end of which is connected to the drive unit, in which the drive unit has a drum for winding and unwinding the raising wire and the lowering wire, a motor for driving the drum and a housing, and the housing has a drum housing portion for housing the drum, a guide rail connecting portion connected to the guide rail, a stopper which abuts the carrier plate when the carrier plate reaches its lower limit position and prevents the carrier plate from further lowering therefrom, and a stopper supporting portion provided below the stopper in the lowering direction of the carrier plate.

In the window regulator of the presently disclosed embodiment, the housing of the drive unit provided at the end of the guide rail for guiding the raising and lowering movement of the carrier plate has the stopper which abuts the carrier plate when the carrier plate reaches its lower limit position and prevents it from further lowering from there, and a stopper supporting portion provided below the stopper in the lowering direction of the carrier plate. Therefore, it is not necessary to separately provide a bracket for fixing the stopper and an impact caused when the stopper abuts the carrier plate can be surely supported.

In the window regulator of the presently disclosed embodiment, since the housing is made of a synthetic resin, further weight reduction is achieved and due to the weight reduction, the cross section of the stopper supporting portion can be made larger. Therefore, an impact caused when the stopper abuts the carrier plate can be dispersed.

In the window regulator of the presently disclosed embodiment, the carrier plate has a guide rail fitting portion fitted to the guide rail, wire end connecting portions for connecting the one ends of the raising wire and the lowering wire, and a stopper abutting portion for abutting the stopper. The guide rail fitting portion and the stopper abutting portion are provided so as to interpose the wire end connecting portions between the guide rail fitting portion and the stopper abutting portion in a direction vertical to the raising and lowering direction of the carrier plate, and therefore, an impact caused when the stopper abuts the carrier plate can be supported more securely.

DETAILED DESCRIPTION

Figure 1:
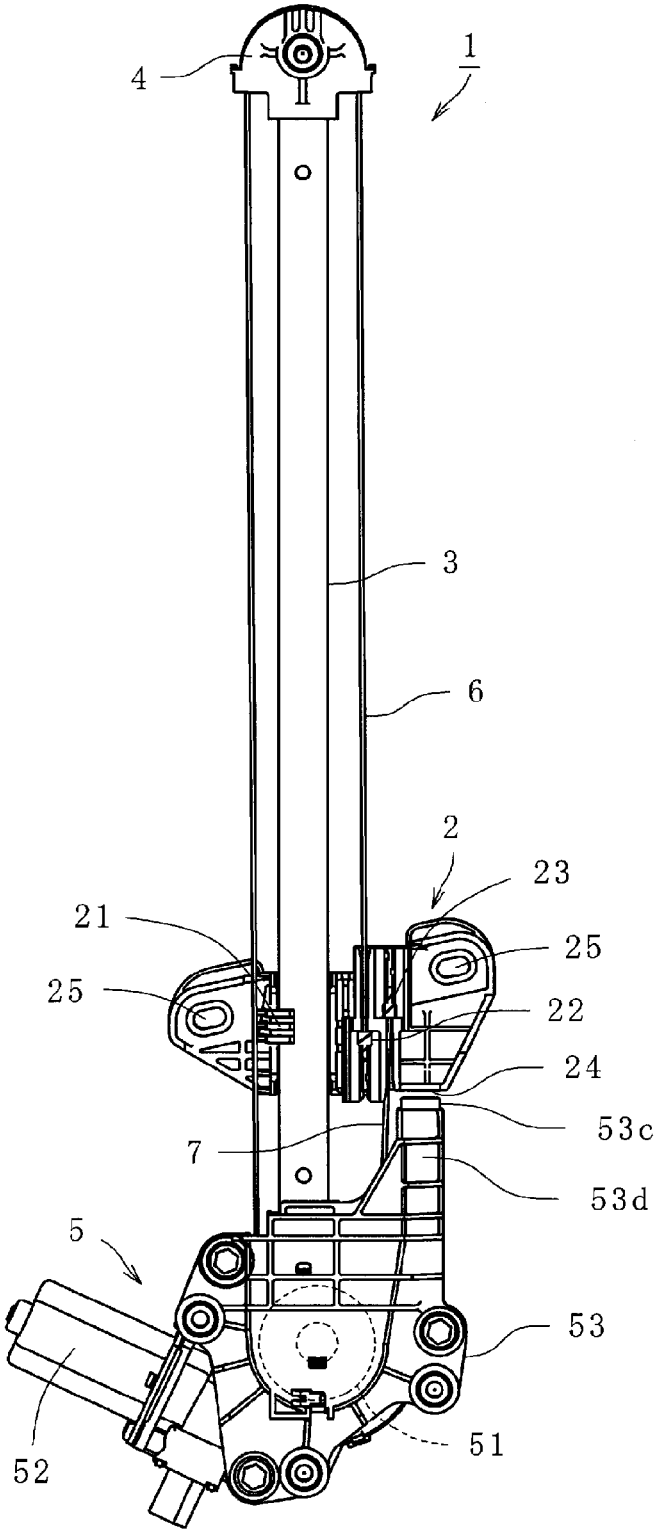
FIG. 1 is a schematic front view illustrating one embodiment of a window regulator according to the presently disclosed embodiment.

The presently disclosed embodiment is explained below by referring to the drawings. A window regulator 1 of the presently disclosed embodiment is to be provided on doors and the like of a vehicle for opening and closing a window glass not shown in the drawings. As shown in FIG. 1, the window regulator 1 comprises a carrier plate 2 connected to the window glass of a vehicle, a guide rail 3 for guiding raising and lowering movements of the carrier plate 2, a direction changing member 4 provided at one end of the guide rail 3, a drive unit 5 provided at another end of the guide rail 3, a raising wire 6, one end of which is connected to the carrier plate 2 and another end of which is connected to the drive unit 5 via the direction changing member 4, and a lowering wire, one end of which is connected to the carrier plate 2 and another end of which is connected to the drive unit 5.

The carrier plate 2 has, as shown in FIG. 1, a guide rail fitting portion 21 fitted to the guide rail 3, wire end connecting portions 22, 23 for connecting the respective one ends of the raising wire 6 and the lowering wire 7 thereto, and a stopper abutting portion 24 for abutting a stopper 53*c*, described below, at a lower limit position of the carrier plate 2, and the carrier plate 2 is provided so as to move slidably in the vertical direction along the guide rail 3. This carrier plate 2 can be formed integrally, for example, using a synthetic resin, and may be formed by fixing separate parts each other by heat sealing. In addition, the material of the carrier plate 2 is not limited particularly to a synthetic resin, and may be a metal, a combination of a metal with a synthetic resin, and the like.

The guide rail fitting portion 21 and the stopper abutting portion 24 of the carrier plate 2 are, as shown in FIG. 1, provided so as to interpose the wire end connecting portions 22, 23 therebetween in a direction vertical to the raising and lowering direction of the carrier plate 2. Namely, the guide rail fitting portion 21 and the stopper abutting portion 24 are provided so as to locate at both sides of the wire end connecting portions 22, 23. The guide rail fitting portion 21 is formed like a claw so as to be engaged with the side edge of the guide rail 3 extending in its longitudinal direction. However, the guide rail fitting portion 21 is not limited to this embodiment, and may be any configuration allowing the guide rail fitting portion 21 to be slidably fitted to the guide rail 3. Further, fixing holes 25 for fixing a window glass, not shown in the drawing, with screws and the like are formed in the carrier plate 2.

The guide rail 3 is formed into a U-shape in its cross section by bending both side portions in a widthwise direction of a substantially rectangular metal sheet such as a galvanized steel sheet having a predetermined length in the raising and lowering direction of the carrier plate 2 at substantially a right angle in the same direction.

The direction changing member 4 is used for winding the raising wire 6 thereon and changing the direction of the raising wire 6, and though not illustrated in detail, a circular arc shaped guide groove for slidably guiding the raising wire 6 is formed in the direction changing member 4. Here, the direction changing member 4 is not limited to this embodiment, and a rotatable pulley may be provided on the upper end of the guide rail 3 directly or via a bracket.

The drive unit 5 is, as shown in FIG. 1, mounted to the lower end of the guide rail 3 and is arranged so as to be located below the lower limit position of the carrier plate 2. This drive unit 5 has a drum 51 for winding and unwinding the raising wire 6 and the lowering wire 7, a motor 52 for driving the drum 51 and a housing 53.

Though not illustrated in detail, the drum 51 is provided with engagement portions for engaging the end portions of the raising wire 6 and the lowering wire 7, and a spiral guide groove for winding the vicinity of the end portions of the raising wire 6 and the lowering wire 7 are provided on the outer peripheral surface of the drum. Further, the drum 51 is connected to the motor 52 via a reduction gear (not shown in the drawing) such as a worm gear speed reducer, and by driving the motor 52, winding and unwinding of the raising wire 6 and the lowering wire 7 are performed.

Figure 2:
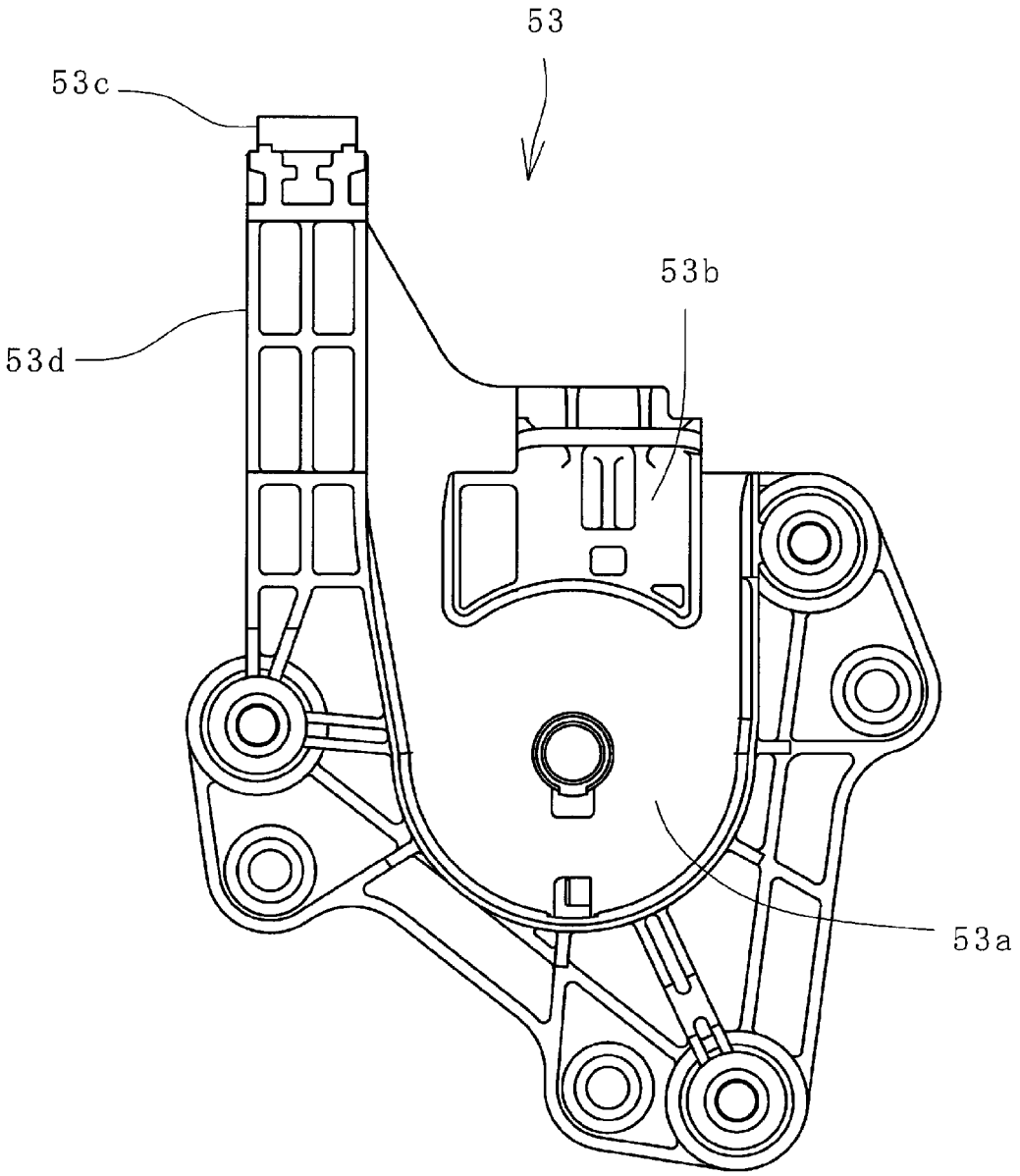
FIG. 2 is a schematic explanatory view illustrating one example of the inside of a housing.
Figure 3:
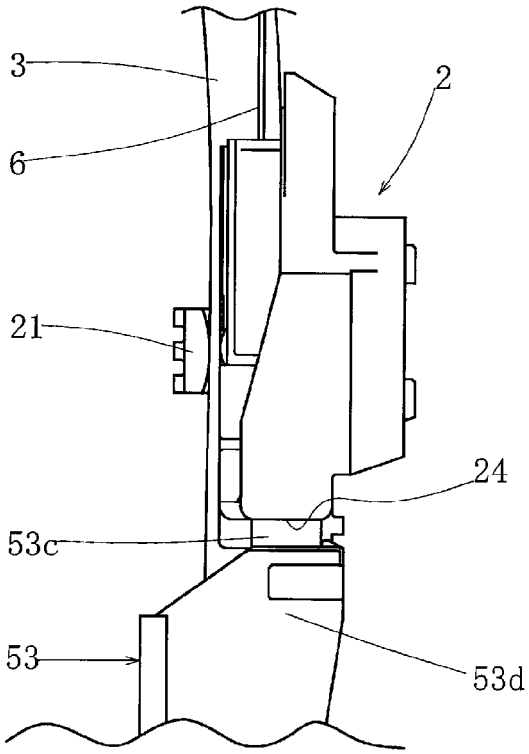
FIG. 3 is a schematic side view illustrating one embodiment of the window regulator according to the presently disclosed embodiment.

As shown in FIGS. 1 and 2, the housing 53 has a drum housing portion 53*a* for housing the drum 51, a guide rail connecting portion 53*b* connected to the lower end portion of the guide rail 3, a stopper 53*c* for preventing the carrier plate 2 from lowering below the lower limit position, and a stopper supporting portion 53*d* for supporting the stopper 53*c*. The material of the housing 53 is not limited particularly, and for example, the use of a synthetic resin can lead to weight reduction.

The stopper 53*c* is intended to restrict the lower limit position of the carrier plate, and abuts the carrier plate 2 when lowering the window glass to stop the carrier plate 2 at its lower limit position. In the embodiment, the stopper 53*c* is abutted to the stopper abutting portion 24 of the carrier plate 2. However, the stopper 53*c* may abut any portion of the carrier plate 2 as long as the carrier plate 2 can be stopped at its lower limit position. The material of the stopper 53*c* is not limited particularly, and for example, an elastic member or the like can be used for decreasing an impulsive sound at the time of abutting the stopper abutting portion 24.

The stopper supporting portion 53*d* is intended to support the stopper 53*c*, and is provided below the stopper 53*c* in the lowering direction of the carrier plate 2. At an end portion of the stopper supporting portion 53*d*, for example, a fitting portion for mounting the stopper 53*c* thereon is formed, and by fitting the lower end side of the stopper 53*c* to the fitting portion, the stopper 53*c* is provided at the top end portion of the stopper supporting portion 53*d*. As mentioned above, the stopper supporting portion 53*d* supports the stopper 53*c* from below and is integrated with the housing 53, and therefore, the stopper 53*c* can surely support the impact caused when the stopper 53*c* abuts the stopper abutting portion 24 of the carrier plate 2. Further, the housing 53 is formed of a synthetic resin or the like for weight reduction and due to the weight reduction, the cross section of the stopper supporting portion 53*d* can be made larger so that the strength can be increased. In addition, while in this embodiment, the stopper 53*c* made of an elastic member or the like is provided on the end portion of the stopper supporting portion 53*d*, the end surface of the stopper supporting portion 53*d* may serve as the stopper 53*c* by abutting the end surface of the stopper supporting portion 53*d* directly on the stopper abutting portion 24 of the carrier plate 2.

The movement of the window regulator 1 of the presently disclosed embodiment is explained below. Since the window regulator 1 of the presently disclosed embodiment is provided with the configuration mentioned above, the motor 52 drives and rotates the drum via the reduction gear to wind the raising wire 6 on the drum 51 and unwind the lowering wire 7 from the drum 51 to the one end, thereby the carrier plate 2 is raised. By raising the carrier plate 2 in such a way, the window glass fixed to the carrier plate 2 is also raised. Further, by the reverse rotation of the motor 52, the raising wire 6 is unwound from the drum 51 to the one end and the lowering wire 7 is wound on the drum 51, thereby enabling the window glass as well as the carrier plate 2 to be lowered.

As mentioned above, when the carrier plate 2 is lowered and reaches its lower limit position, the stopper abutting portion 24 of the carrier plate 2 abuts the stopper 53*c* supported by the stopper supporting portion 53*d* to prevent the carrier plate 2 from further lowering below the lower limit position.

In the window regulator 1 of the presently disclosed embodiment, since the stopper 53*c* is provided on the housing 53 of the drive unit 5, it is not necessary to provide a bracket for fixing the stopper 53*c* and thus the number of components can be reduced. In addition, since the stopper 53*c* is supported by the stopper supporting portion 53*d* from below, the impact caused when the stopper abuts the carrier plate 2 can be supported securely.

As shown in FIG. 1, the guide rail fitting portion 21 and the stopper abutting portion 24 are provided so as to interpose the wire end connecting portions 22, 23 between the guide rail fitting portion 21 and the stopper abutting portion 24 in a direction vertical to the raising and lowering direction of the carrier plate 2, and therefore, when the stopper abutting portion 24 abuts the stopper 53*c*, the carrier plate 2 can be prevented from rotating (rotating toward the rear side of a vehicle) around the guide rail fitting portion 21 due to a tension applied to the raising wire 6 in the lowering direction. By this, when the window glass mounted to the carrier plate 2 is in a state of being fully open, namely when the carrier plate 2 abuts the stopper 53*c*, the window glass can be prevented from rotating toward the rear side of a vehicle, and therefore, the appearance of the window glass when window glass is not worsened. Further, when the carrier plate 2 is raised from the state of the window glass being fully open, a contact noise between the glass and a glass run channel which is generated by the rotation of the window glass toward a front side of a vehicle can be prevented.

The aspects of the presently disclosed embodiment are not limited to those mentioned above, and can be modified appropriately within the scope of the idea of the presently disclosed embodiment.

The window regulator of the presently disclosed embodiment can be applied to doors and the like of a vehicle.

EXPLANATION OF SYMBOLS

1 Window regulator
2 Carrier plate
21 Guide rail fitting portion
22, 23 Wire end connecting portions
24 Stopper abutting portion
3 Guide rail
4 Direction changing member
5 Drive unit
51 Drum
52 Motor
53 Housing
53*a* Drum housing portion
53*b* Guide rail connecting portion
53*c* Stopper
53*d* Stopper supporting portion
6 Raising wire
7 Lowering wire
72 Fixing portion

What is claimed is:

1. A window regulator comprising:

a carrier plate connected to a window glass of a vehicle, a guide rail for guiding raising and lowering the carrier plate, a direction changing member provided at one end of the guide rail, a drive unit provided at another end of the guide rail, a raising wire, one end of which is connected to the carrier plate and another end of which is connected to the drive unit via the direction changing member, and a lowering wire, one end of which is connected to the carrier plate and another end of which is connected to the drive unit, wherein the drive unit has a drum for winding and unwinding the raising wire and the lowering wire, a motor for driving the drum, and a housing, and the housing has a drum housing portion for housing the drum, a guide rail connecting portion connected to the guide rail, a stopper which abuts the carrier plate when the carrier plate reaches a carrier plate lower limit position and prevents the carrier plate from further lowering therefrom, and a stopper supporting portion provided below the stopper in a raising and lowering direction of the carrier plate and extending along a longitudinal axis which is generally parallel to the raising and lowering direction of the carrier plate so that a gap between the guide rail and the stopper supporting portion is formed, wherein the gap lies in a plane generally perpendicular to the raising and lowering direction of the carrier plate.

2. The window regulator of claim 1, wherein the housing is made of a synthetic resin.

3. The window regulator of claim 1, wherein the carrier plate has a guide rail fitting portion fitted to the guide rail, wire end connecting portions for connecting the one end respectively of the raising wire and the lowering wire to the carrier plate, and a stopper abutting portion for abutting the stopper, and the guide rail fitting portion and the stopper abutting portion are provided so as to interpose the wire end connecting portions between the guide rail fitting portion and the stopper abutting portion.

4. The window regulator of claim 1, wherein the carrier plate has a guide rail fitting portion fitted to the guide rail, wire end connecting portions for connecting the one end respectively of the raising wire and the lowering wire to the carrier plate, and a stopper abutting portion for abutting the stopper, and the carrier plate is attached to the guide rail so that the wire end connecting portions are interposed between the guide rail and the stopper abutting portion.

* * * * *